US010661459B2

(12) United States Patent
Vonk et al.

(10) Patent No.: US 10,661,459 B2
(45) Date of Patent: May 26, 2020

(54) HAIR CLIPPING DEVICE

(71) Applicant: KONINKLIJKE PHILIPS N. V., Eindhoven (NL)

(72) Inventors: Arjan Sander Vonk, Eindhoven (NL); Julien Philippe Latul, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 72 days.

(21) Appl. No.: 15/323,835

(22) PCT Filed: Jun. 12, 2015

(86) PCT No.: PCT/EP2015/063117
§ 371 (c)(1),
(2) Date: Jan. 4, 2017

(87) PCT Pub. No.: WO2016/005142
PCT Pub. Date: Jan. 14, 2016

(65) Prior Publication Data

US 2017/0129113 A1 May 11, 2017

(30) Foreign Application Priority Data

Jul. 7, 2014 (EP) ..... 14175908

(51) Int. Cl.
*B26B 19/38* (2006.01)
*B26B 19/20* (2006.01)
*B26B 19/06* (2006.01)

(52) U.S. Cl.
CPC ..... *B26B 19/388* (2013.01); *B26B 19/06* (2013.01); *B26B 19/20* (2013.01)

(58) Field of Classification Search
CPC ..... Y10T 83/162–18; Y10T 83/173; B26B 19/388; B26B 19/3873; B26B 19/20; E03C 1/055; E03C 1/057
(Continued)

(56) References Cited

U.S. PATENT DOCUMENTS 4,602,542 A 7/1986 Natrasevschi
5,581,529 A * 12/1996 Roth ..... G11B 5/09 360/32
(Continued)

FOREIGN PATENT DOCUMENTS

EP 1710055 A1 * 10/2006 ..... B26B 19/20
WO 2010125522 A1 11/2010
(Continued)

*Primary Examiner* — Laura M Lee

(57) ABSTRACT

The present invention relates to a hair clipping device (10) comprising: a housing (14), a cutting assembly (16) for clipping hairs, a comb attachment (12) which is attachable to the housing (14), a drive unit (38) for moving the comb attachment (12) relative to the cutting assembly (16) between different comb positions in order to set a hair cut-length, a control unit (36) for controlling the drive unit (38), a memory unit (40), and a user interface (34). The user interface (34) is configured to receive from a user a first memory input indicative of a first comb position and to send a first memory signal to the control unit (36) in response to receiving the first memory input, and wherein the user interface (34) is configured to receive from the user a first recall input indicative of the first comb position and to send a first recall signal to the control unit (36) in response to receiving the first recall input, wherein the control unit (36) is configured to store position information regarding the first comb position in the memory unit (40) in response to receiving the first memory signal, and wherein the control unit (36) is configured to recall the position information regarding the first comb position from the memory unit (40) in response to receiving the first recall signal and to control the drive unit (38) to move the comb attachment (12) to the first comb position according to the position information regarding the first comb position.

10 Claims, 5 Drawing Sheets

(58) Field of Classification Search
USPC ..... 30/201, 233.5; 83/76.1–76.9
See application file for complete search history.

(56) References Cited

U.S. PATENT DOCUMENTS

| | | | | |
|---|---|---|---|---|
| 2005/0146444 | A1* | 7/2005 | Allen | G08C 19/28 340/4.37 |
| 2005/0227649 | A1* | 10/2005 | Chestnut | H03J 1/0075 455/154.1 |
| 2008/0163495 | A1 | 7/2008 | Smal | |
| 2009/0211417 | A1* | 8/2009 | Rummel | B26D 5/00 83/74 |
| 2010/0186234 | A1 | 7/2010 | Binder | |
| 2012/0017367 | A1* | 1/2012 | Reeder | E03C 1/055 4/597 |
| 2012/0233866 | A1 | 9/2012 | Kammer | |
| 2012/0234146 | A1 | 9/2012 | Lakin | |
| 2017/0129113 | A1 | 5/2017 | Vonk | |

FOREIGN PATENT DOCUMENTS

| | | | |
|---|---|---|---|
| WO | 2013096572 | A1 | 6/2013 |
| WO | 2013163999 | A1 | 11/2013 |

* cited by examiner

HAIR CLIPPING DEVICE

FIELD OF THE INVENTION

The present invention relates to a hair clipping device with a comb attachment that is attachable to the housing of the hair clipping device. The present invention particularly relates to a hair clipping device with a memory function allowing users to store their favorite length setting and quickly change the length setting by selecting a memory entry.

BACKGROUND OF THE INVENTION

Electric hair cutting appliances are generally known and include trimmers, clippers and shavers, whether powered by main supplied electricity or batteries. Such devices are generally used to trim body hair, in particular facial and head hair to allow a person to have a well-groomed appearance.

Commonly, conventional devices for cutting hair comprise a main body forming an elongate housing having a front or cutting end (herein referred to as distal end) and an opposing handle end. A cutting assembly is disposed at the distal end. The cutting assembly usually comprises a stationary cutting blade with a stationary cutting edge and a moveable cutting blade with a moveable cutting edge. The moveable cutting blade moves in a reciprocal manner against the stationary cutting blade. The cutting assembly is usually fixed in a single position relative to the housing of the hair clipper, such that the orientation of the cutting assembly is determined by a user orientating the housing or main body of the hair clipping device. The stationary cutting edge and the moveable cutting edge are arranged at the tip portions of the stationary cutting blade and the moveable cutting blade, respectively. These cutting edges usually jut out of the front side of the housing of the hair clipping device, such that the cutting edges are always visible to the user. This makes it easier for the user to see where exactly the hairs are cut, which is specifically advantageous when using the hair clipping device to form and create fine hair contours.

Since there is a great user demand for hair clipping devices that offer the possibility to be used for different hair cut-lengths, many known hair clipping devices make use of separate, differently sized comb attachments. These comb attachments are generally mounted on the distal end of the hair clipping device to position the cutting assembly relative to the skin. In other words, such a comb attachment is used as a guide that moves over the skin and guides hair towards the cutting assembly. Typically, the comb attachment is mounted over the cutting assembly and spaces the cutting blades, in particular their cutting edges (the stationary cutting edge and the moveable cutting edge), apart from the surface of the skin from which the hairs extend. However, always having to replace the comb attachment by a different one when the hair cut-length shall be changed might be cumbersome for the user, as this is not only time-consuming, but the user also has to store a plurality of differently sized comb attachments.

Therefore, a lot of prior art hair clipping devices use only one comb attachment that is adjustable in different positions relative to the housing of the hair clipping device. Users may thus shift the comb attachment between different positions leading to different hair cut-lengths. Usually these moveable comb attachments may be adjusted between hair cut-lengths of 3 mm, 5 mm, 7 mm, 9 mm, usually up to 12 or 15 mm. Most of the prior art hair clipping devices using such adjustable comb attachments provide a mechanical solution for moving the comb attachment relative to the housing of the hair clipping device. Users may thus shift the comb attachment by hand between the different positions.

US 2012/0233866 A1 discloses a hair clipping device with an adjustable comb attachment, wherein the position of the comb attachment may be adjusted by means of an electric motor. This motor may be controlled via a touchscreen that is integrated into the housing of the hair clipping device. The user may thus shift the comb attachment between the different positions by using two buttons on the touchscreen, one button for moving the comb attachment relative to the cutting assembly to increase the hair cut-length and the other button for moving the comb attachment relative to the cutting assembly to decrease the cutting length. This facilitates the handling for the user compared to mechanically adjustable comb attachments. However, users sometimes still have problems to correctly adjust the comb attachment in an electronic way. Shifting from a very short hair cut-length to a very long hair cut-length sometimes also appears to be tedious and could take quite long.

There is thus still room for improvement.

SUMMARY OF THE INVENTION

It is an object of the present invention to provide a hair clipping device which overcomes the above-mentioned problems. In particular, it is an object to provide an improved hair clipping device with an attachable comb attachment, wherein the handling for adjusting the comb attachment in the different positions is facilitated for the user.

According to an aspect of the present invention, a hair clipping device is provided which comprises:

- a housing;
- a cutting assembly for clipping hairs;
- a comb attachment which is attachable to the housing;
- a drive unit for moving the comb attachment relative to the cutting assembly between different comb positions in order to set a hair cut-length;
- a control unit for controlling the drive unit;
- a memory unit; and
- a user interface which is configured to receive from a user a first memory input indicative of a first comb position and to send a first memory signal to the control unit in response to receiving the first memory input, and wherein the user interface is configured to receive from the user a first recall input indicative of the first comb position and to send a first recall signal to the control unit in response to receiving the first recall input, wherein the control unit is configured to store position information regarding the first comb position in the memory unit in response to receiving the first memory signal, and wherein the control unit is configured to recall the position information regarding the first comb position from the memory unit in response to receiving the first recall signal and to control the drive unit to move the comb attachment to the first comb position according to the position information regarding the first comb position.

It shall be noted that the word "first" used in the terms "first memory input", "first comb position", "first memory signal", "first recall input" and "first recall signal" in the claims shall not imply any temporal meaning or chronological order, but shall only help to distinguish between different memory inputs, comb positions, memory signals, recall inputs and recall signals.

The presented hair clipping device allows adjusting the comb attachment between different comb positions by means of a drive unit which may include an electric motor, similar as this is realized in the hair clipping device known from US 2012/0233866 A1. The presented hair clipping device, however, does not only allow moving the comb attachment between different comb positions "manually" by using a user interface which may include one or more buttons for controlling the drive unit, but also allows the user to store his/her favorite length settings and recall these length settings if needed. The presented hair clipping device is thereto equipped with a memory unit in which the different length settings that the user favors may be stored. The user may control the hair clipping device by means of a user interface which may include one or more buttons, a touch panel or a touchscreen. This user interface is preferably arranged at or within the housing of the hair clipping device.

The memory function of the presented hair clipping device enables the user to very quickly change the comb position to the hair cut-length setting he/she favors. The user thereto only has to recall the position information regarding the desired comb position from the memory unit by means of an interaction with the user interface, e.g. by pressing a button. The control unit will then recall the stored position information regarding the comb position from the memory unit and control the drive unit to move the comb attachment to said comb position. The comb attachment may thus be automatically brought into the preferred comb position by only one click of the user. In other words, the user does no longer have to adjust the comb position him-/herself until the favorite length setting is reached.

The presented hair clipping device is especially advantageous, since the inventors of the present invention have realized from product studies that most of the users typically use only a limited number of length settings provided by the hair clipping device. If these favorite length settings may be stored in the memory unit by the user him-/herself, the user may so to say program the hair clipping device according to his/her personal needs. The everyday handling of the hair clipping device is thus much more comfortable and quicker for the user.

Preferred embodiments of the invention are defined in the dependent claims.

According to an embodiment, the user interface comprises a first button or first input field for receiving from the user the first memory input as well as the first recall input, wherein the user interface is configured to send the first memory signal to the control unit if the first button or first input field is activated for a predetermined first period of time, and wherein the user interface is configured to send the recall signal to the control unit if the first button or first input field is activated for a predetermined second period of time.

In other words, the same button or input field (i.e. the first button or first input field) may be used for storing a desired comb position (i.e. the first comb position) in the memory unit as well as for recalling said comb position again from the memory unit in order to move the comb attachment into said comb position by means of the drive unit. This facilitates the handling for the user, since he/she may control the complete memory function with only one button or input field.

The term "button" shall imply a "real" physical button, whereas the term "input field" shall imply a virtual button that may e.g. be provided on a touchscreen.

The control unit of the hair clipping device is configured to distinguish whether the user wants to store a new comb position in the memory unit or recall an older comb position from the memory unit by identifying the time length the first button or first input field is activated by the user. If the first button or input field is activated for a predetermined first period of time, the currently set comb position will be stored in the memory unit. If the first button or first input field is activated by the user for a second period of time, the control unit will recall the stored comb position from the memory unit and activate the drive unit to move the comb attachment into the comb position stored in the memory unit.

According to a preferred embodiment, said predetermined second period of time is shorter than the predetermined first period of time. In other words, if the user activates the first button or first input field e.g. for 1 sec or more (predetermined first period of time), the first memory signal will be generated, such that the control unit in turn stores the position information regarding the set comb position in the memory unit. If, on the other hand, the first button or first input field is activated e.g. for less than 1 sec (predetermined second period of time), e.g. by only pressing or clicking on the first button or first input field, the first recall signal will be generated, such that the control unit in turn recalls the position information of the previously stored comb position from the memory unit and controls the drive unit to move the comb attachment to the recalled comb position according to the position information stored in the memory unit. The user may thus save a new comb position by simply pressing the first input button or input field for a longer time, whereas he/she may recall a stored comb position in order to set the comb attachment into the stored position by simply clicking on the first button or first input field.

Alternatively, the user interface may comprise (i) a first button or first input field for receiving from the user the first memory input and (ii) a second button or second input field for receiving from the user the recall input. In other words, the user interface in this case comprises at least two buttons, one button for storing a new comb position and another button for recalling the stored comb positions and automatically moving the comb attachment to the recalled comb position.

According to a further embodiment, the user interface comprises a display that is configured to display position information regarding an actual comb position and/or the position information regarding the first comb position in response to receiving the first recall input.

Such a display gives the user a feedback about the actual comb position that is currently set. As soon as the user recalls a stored comb position from the memory unit via the user interface, the display may be configured to switch from displaying the actual comb position to displaying the stored comb position. This is especially advantageous if the memory unit comprises a memory bank with a plurality of memory locations, as this will be elucidated in detail further below.

According to a further embodiment, the hair clipping device further comprises a feedback actuator which includes at least one of an optical, acoustical or tactile actuator, wherein the control unit is configured to activate the feedback actuator in response to the position information regarding the first comb position being stored in the memory unit.

In this case the user receives a feedback that the position information of the comb position has been stored successfully in the memory unit. As soon as the user receives said feedback, he/she may stop activating the first button or first input field, i.e. the user may release the first button or first input field.

The feedback actuator may be realized in many ways. It can be a part of the display, such that e.g. a symbol is blinking to reassure the user the desired comb position/hair cut-length setting has been stored in the memory unit. Alternatively, a small loudspeaker may be integrated into the housing of the hair clipping device, wherein the loudspeaker produces a sound in the above-mentioned situation. In a further alternative, the hair clipping device may comprise a vibrator that vibrates in the above-mentioned situation.

According to a further embodiment, the user interface is further configured to receive from the user a second memory input indicative of a second comb position and to send a second memory signal to the control unit in response to receiving the second memory input, wherein the user interface is configured to receive from the user a second recall input indicative of the second comb position and to send a second recall signal to the control unit in response to receiving the second recall input, wherein the control unit is configured to store position information regarding the second comb position in the memory unit in response to receiving the second memory signal, and wherein the control unit is configured to recall the position information regarding the second comb position from the memory unit in response to receiving the second recall signal and to control the drive unit to move the comb attachment to the second comb position according to the position information regarding the second comb position.

In other words, the hair clipping device according to this embodiment enables the storage of two hair cut-length settings in the memory unit. It shall be understood that the hair clipping device may of course also enable the storage of more than two hair cut-length settings. According to a preferred embodiment, the memory unit comprises three or more memory locations.

According to a further embodiment, the user interface comprises (i) a display and (ii) a first button or first input field for receiving from the user the first memory input, the second memory input, the first recall input as well as the second recall input, wherein the user interface is configured to show a selection menu on the display if the first button or first input field is activated for a predetermined first period of time, the selection menu allowing the user to select sending the first or the second memory signal to the control unit, wherein the user interface is configured to send the first recall signal to the control unit if the first button or first input field is activated once for a predetermined second period of time, and wherein the user interface is configured to send the second recall signal to the control unit if the first button or first input field is activated twice for the predetermined second period of time, the predetermined second period of time being shorter than the predetermined first period of time.

This embodiment allows controlling the memory function by only one button or input field, even though two or more than two hair cut-length settings may be stored in the memory unit and recalled from the memory unit. The handling of the device is thus still kept as simple as possible for the user. For storing a hair cut-length setting the user may, for example, keep the first button or first input field pressed for one second or longer (predetermined first period of time). The display will then show the selection menu which graphically shows the user several options in which memory locations the desired hair cut-length setting/comb position may be stored. The user may then select one memory location and confirm the selection, e.g. by pressing the first button or first input field again.

If the user wants to recall one of the stored hair cut-length settings from the memory, the user has to activate the first button or first input field by a simple click or e.g. pressing said button/input field for less than 1 sec (predetermined second period of time). After pressing the first button or first input field a first time, the comb attachment will move into the first comb position stored in the memory unit. If the first button or input field is then pressed a second time, the comb attachment will move to the next comb position stored in the memory unit, etc.

According to a further embodiment, the user interface comprises (i) a display and (ii) a hair cut-length controller for receiving from the user a hair cut-length input indicative of a desired comb position, wherein the control unit is configured to move the comb attachment to the desired comb position in response to the hair cut-length input.

In other words, the comb attachment may not only be moved automatically by recalling a pre-stored comb position from the memory unit, but the user may also "manually" control the drive unit to move the comb attachment into a desired position. The drive unit may either be configured to move the comb attachment in a stepless manner or in a stepwise manner, e.g. in steps of 1 mm. The hair cut-length controller may be realized in many ways. It may comprise a sliding bar or a turning wheel. In these cases, the comb attachment will be forced to move if the sliding bar is shifted up or down, or if the turning wheel is rotated left or right, respectively. The hair cut-length controller may alternatively comprise two buttons, one button for increasing the distance between the comb attachment and the cutting assembly, i.e. for increasing the hair cut-length, and one button for decreasing the distance between the comb attachment and the cutting assembly, i.e. for decreasing the hair cut-length.

According to a further embodiment, the hair clipping device comprises a first and a second comb attachment having different sizes and/or shapes, and wherein the hair clipping device further comprises a comb recognition unit that is configured to identify whether the first or the second comb attachment is attached to the housing, wherein the recognition unit is furthermore configured to change settings of the control unit, the memory unit and/or the user interface depending on the identification of the first or the second comb attachment.

In other words, the system in this embodiment automatically recognizes what kind of comb attachment is attached to the housing of the hair clipping device. The housing may, for example, comprise several switches, wherein the first type of comb attachment is configured to activate the first switch and the second type of comb attachment is configured to activate the second switch. Alternatively, each comb attachment may comprise an RFID tag which is automatically identified by the recognition unit.

Recognizing different types of comb attachments has the advantage that the system may automatically adapt itself to the particular comb attachment. The user interface may be particularly adapted to each type of comb attachment. If the comb attachment in the smallest hair cut-length setting already leads to a hair cut-length of e.g. 6 mm, the user interface may indicate the user via the display that the smallest possible hair cut-length setting for this comb attachment is 6 mm. If a smaller comb attachment is attached to the hair clipping device allowing a minimal hair cut-length of e.g. 3 mm, the display may indicate the user that the smallest possible hair cut-length for said comb attachment is 3 mm. The memory unit may be adapted to the specific comb attachment in a similar way. For example, it may be possible for the user to store three hair cut-length settings in the memory unit for each of the different comb attachments. If the first comb attachment is attached to the housing of the hair clipping device, the user may recall three different comb positions from the memory unit that he/she pre-saved in the memory unit for this particular comb attachment. If the user then attaches the second comb attachment, the user may recall three other comb positions that he/she stored in the memory unit for the second comb attachment.

According to a preferred embodiment, the cutting assembly comprises a moveable cutting blade and a stationary cutting blade, wherein the hair clipping device further comprises (i) a motor for driving the moveable cutting blade and (ii) an activation button or activation input field for activating and deactivating the motor. This activation button or activation input field may be different from the aforementioned first button or first input field. However, the activation input field may also be a part of a touchscreen via which the user controls the memory function in the way explained above.

BRIEF DESCRIPTION OF THE DRAWINGS

These and other aspects of the invention will be apparent from and elucidated with reference to the embodiment described hereinafter. In the following drawings

DETAILED DESCRIPTION OF THE INVENTION

Figure 1:
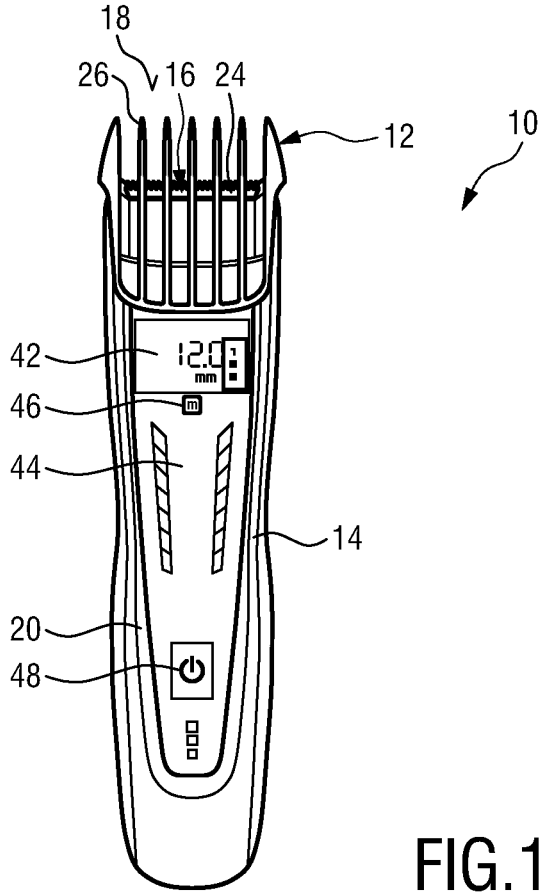
FIG. 1 shows a front view of an exemplary embodiment of a hair clipping device according to the present invention.
Figure 2:
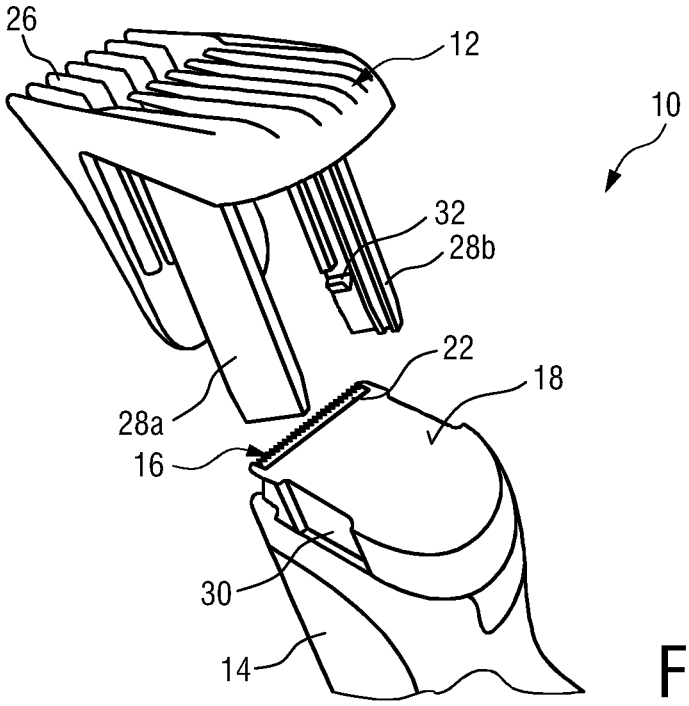
FIG. 2 shows a partial exploded view of the exemplary embodiment of the hair clipping device according to the present invention.

FIGS. 1 and 2 show an exemplary embodiment of the hair clipping device according to the present invention in a top view (FIG. 1) as well as in a partial exploded view (FIG. 2). The hair clipping device is therein in its entirety denoted with reference numeral 10.

The hair clipping device 10 comprises a comb attachment 12 which is releasably attachable to the hair clipping device 10. The hair clipping device 10 further comprises a housing 14 in which all remaining parts are usually integrated and to which the comb attachment 12 may be attached. The housing 14 also serves as a holder for a cutting assembly 16. The cutting assembly 16 may be releasably fixed to a distal end 18 of the housing 14. The cutting assembly 16 may, however, also be permanently fixed to the distal end 18 of the housing. The housing 14 is usually realized as an elongated body that forms a handle 20 at its rear end, i.e. the end opposite the distal end 18.

The cutting assembly 16 comprises a stationary cutting blade 22 and a moveable cutting blade 24. The moveable cutting blade 24 is in a known manner displaceably mounted on an upper surface of the stationary cutting blade 22. The moveable cutting blade 24 is resilient biased against the stationary cutting blade 22 by means of one or more springs (not shown). These springs exert a spring force onto the moveable cutting blade 24 in order to keep the two cutting blades 22, 24 close together.

During operation hair cutting is performed by the interaction of the stationary cutting blade 22 and the moveable cutting blade 24 that reciprocates on the stationary cutting blade as this is known from other conventional hair clipping devices.

The stationary cutting blade 22 is usually designed to be thicker than the moveable cutting blade 24. Said stationary cutting blade 22 is also denoted as "guard". In order to receive a good cutting performance, the moveable cutting blade 24 is actively pressed onto the upper surface of the guard 22 to receive a so-called teeth pressure. This teeth pressure is, inter alia, guaranteed by the above-mentioned spring that presses the two cutting blades 22, 24 together.

A drive arrangement including a motor (not shown) is configured to drive the moveable cutting blade 24 in an oscillatory manner relative to the stationary cutting blade 22. The motor itself is usually realized as an electric motor that is either powered by main supplied electricity or battery-driven.

Depending on the desired hair cut-length that shall be achieved, the hair clipping device 10 may either be used with or without comb attachment 12. Especially when longer hair cut-lengths are desired, the comb attachment 12 may be attached to the distal end 18 of the housing 14. The comb attachment 12 so to say acts as a spacer between the user's skin and the cutting assembly 16, so that the resulting length of the hair cut is increased compared to a usage of the hair clipping device 10 without comb attachment 12.

The comb attachment 12 comprises a plurality of comb teeth 26 which are preferably arranged parallel to each other. As can be further seen from FIG. 2, the comb attachment 12 comprises an attachment portion which may include, for instance, two beams 28*a*, 28*b*. These two beams may be inserted into respective slots 30 that are provided on each side of a mounting portion of the housing 14. The attachment portion of the comb attachment 12 may further comprise at least one snap-on member 32. This snap-on member 32 may secure the comb attachment 12 when being mounted to the housing 14 of the hair clipping device 10.

Figure 3:
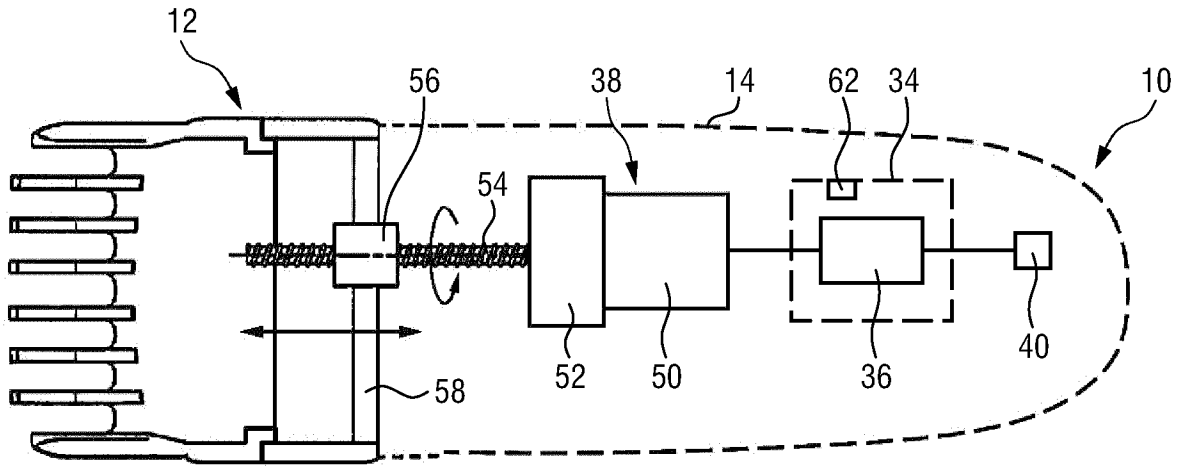
FIG. 3 shows a schematic view in which components of the exemplary embodiment of the hair clipping device according to the present invention are schematically illustrated from a top side.
Figure 4:
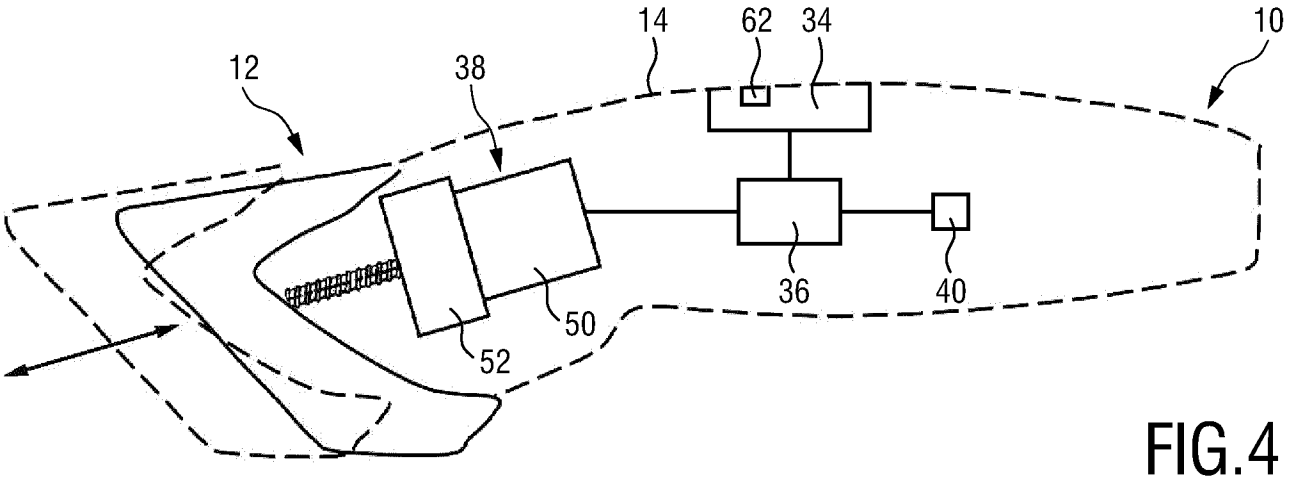
FIG. 4 shows a schematic view in which the components of the exemplary embodiment of the hair clipping device according to the present invention are schematically illustrated from a side.

The comb attachment 12 of the presented hair clipping device may, in contrast to most of the known hair clipping devices of this type, be moved automatically, i.e. in a motorized manner. As schematically shown in FIGS. 3 and 4, the hair clipping device 10 thereto comprises a user interface 34, a control unit 36, a drive unit 38 and a memory unit 40.

The user interface 34 may include a display 42, a hair cut-length controller 44, a memory button 46 (herein also denoted as first button or first input field) and an activation button 48 (see e.g. FIG. 1).

The display 42 may e.g. show the user the actual position of the comb attachment 12, i.e. the display 42 may show the length setting of the comb attachment 12 that is currently set. The display 42 may also show the user the length settings that are stored in the memory unit 40, as this will be elucidated in detail further below.

The hair cut-length controller 44 is configured to receive from the user a hair cut-length input indicative of a desired comb position, such that the control unit 36 in turn moves the comb attachment 12 to the desired comb position by activating the drive unit 38. In the example shown in FIG. 1 the hair cut-length input may be provided by the user by moving a sliding bar that forms part of the hair cut-length controller 44. Shifting this sliding bar upwards may e.g. cause the comb attachment 12 to move away from the cutting assembly 16, such that the hair cut-length setting of the hair clipping device 10 is increased. Shifting the sliding bar of the hair cut-length controller 44 downwards may instead cause the comb attachment 12 to move towards the cutting assembly 16, such that the hair cut-length setting of the hair clipping device 10 is decreased. Instead of the shown sliding bar the hair cut-length controller 44 could also comprise a turning wheel allowing to change the comb position by turning said wheel to the left or to the right, respectively. According to a further alternative, the hair cut-length controller 44 may comprise two buttons, one button for increasing the hair cut-length setting and one button for decreasing the hair cut-length setting.

The activation button 48 enables activating and deactivating the motor (not shown) driving the moveable cutting blade 24. The control circuit for controlling the comb attachment 12 may thus be independent from the control circuit for controlling the cutting assembly 16. However, these two control circuits may alternatively be combined in only one common control circuit.

The comb attachment 12 is moved between the different comb positions by means of the drive unit 38. According to the embodiment shown in FIGS. 3 and 4 the drive unit 38 comprises an actuator 50 or, more particularly, an electromotor. The actuator 50 may be coupled to a gearing member 52 which is coupled to a transmission element 54. This transmission element 54 converts a rotational output motion of the actuator 50 and the gearing member 52, if any, into a basically longitudinal positioning motion of the comb attachment 12. The transmission element 54 may, for example, be realized as a spindle which is coupled to a spindle nut 56 that is mounted to a carriage member 58 of the comb attachment 12. However, it shall be noted that this is only one exemplary way of implementing the drive unit 38. Alternatively, the drive unit 38 could also comprise another type of linear or rotary motor.

One of the central features of the hair clipping device 10 according to the present invention is the application of a memory function allowing the user to store his/her favorite length settings, i.e. his/her favorite comb positions of the comb attachment 12. In this way the user may quickly change the comb position of the comb attachment by selecting a memory entry that he/she stored in advance. This memory function is explained in detail in the following:

The user interface 34 according to the shown example of the hair clipping device 10 comprises a single memory button 46 (herein also denoted as first button or first input field) that the user may use for both storing a desired hair cut-length setting in the memory unit 40 as well as for recalling a stored hair cut-length setting from the memory unit 40.

Figure 5:
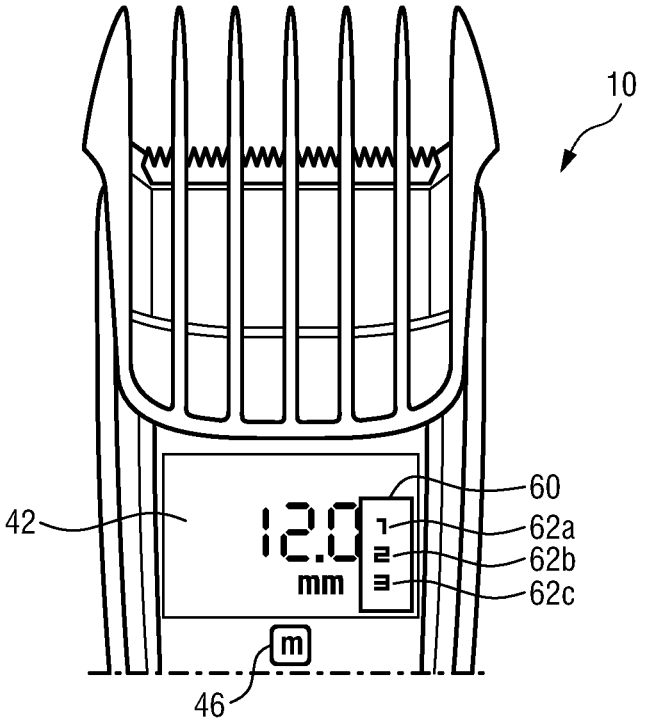
FIG. 5 shows an enlarged view in which a part of a user interface of the exemplary embodiment of the hair clipping device according to the present invention is shown in detail.
Figure 7:
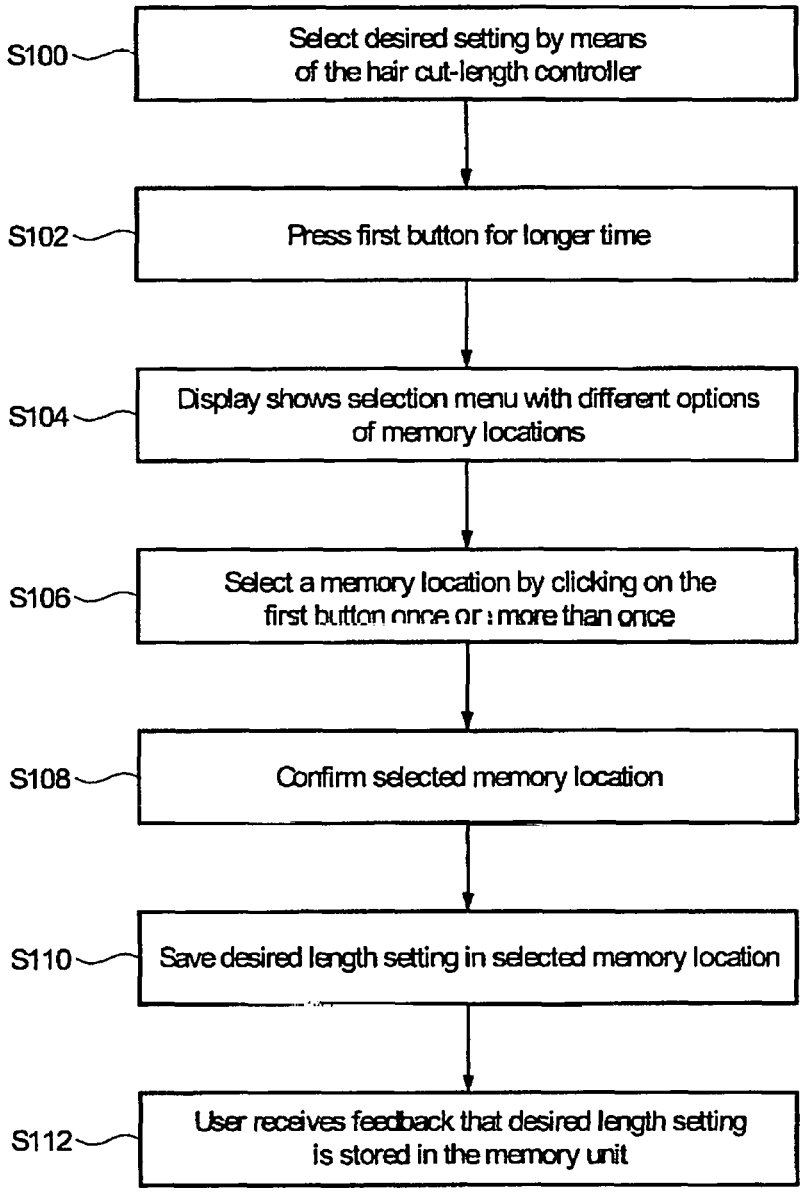
FIG. 7 shows a schematic block diagram illustrating a storing procedure of a memory function that is provided by the hair clipping device according to the present invention.

An exemplary procedure for storing a desired hair cut-length setting in the memory unit 40 is schematically shown in FIG. 7. In a first step S100 the user has to select a desired setting, i.e. a desired comb position, by means of the hair cut-length controller 44. As soon as the comb attachment 12 is positioned in the desired comb position, the user may save this comb position in the memory unit 40. The user may check the comb position via the display 42. In the next step S102 the user has to press the first button 46 for a longer time, e.g. for 1 sec or longer (predetermined first period of time). The display 42 will then show a selection menu 60 with different options of memory locations 62*a*-62*c* (step S104, see also FIG. 5). The display 42 may, for example, show several numbers, each of which indicates a different memory location in the memory unit 40. The selection menu 60 of the display 42 may e.g. be configured to start blinking in order to indicate the user that he/she may now select a memory location 62*a*-62*c*. The user may then select a memory location in step S106 by clicking on the memory button 46 once or more than once. "Clicking" may e.g. mean pressing the memory button 46 for less than 1 sec (predetermined second period of time). If the user presses the memory button 46 in this situation only once, the first memory bank 62*a* will be selected; if he/she presses the memory button 46 twice, the second memory bank 62*b* will be selected; if he/she presses the memory button 46 three times, the third memory bank 62*c* will be selected, etc. In other words, pressing the memory button 46 only once will generate a first memory signal that is sent to the control unit 36. In response to this first memory signal the control unit 36 will store the selected comb setting/position in the first memory bank 62*a* of the memory unit 40. Pressing the memory button 46 twice will generate a second memory signal that is sent to the control unit. In response to the second memory signal the control unit 36 will store the desired comb setting/position in the second memory bank 62*b* of the memory unit 40. Pressing the memory button 46 three times will generate a third memory signal that is sent to the control unit 36. In response to the third memory signal the control unit 36 will store the desired comb setting/position in the third memory bank 62*c* of the memory unit 40. The user may confirm the selected memory location 62*a*-62*c* e.g. by pressing the memory button 46 for 1 sec or longer again. The control unit 36 may be configured to activate a feedback actuator 62 in response to the desired comb setting/position being stored in the memory unit 40 (steps S110 and S112). This feedback actuator 62 may give the user a feedback that the desired length setting has been successfully stored in the memory unit 40. The feedback actuator 62 may either generate a vibration alarm, an acoustical signal or an optical signal. In a preferred embodiment, the feedback actuator 62 is part of the display 42. To reassure the user that the length setting is stored, the selection menu 60 may e.g. blink once more and then dim out.

Figure 6:
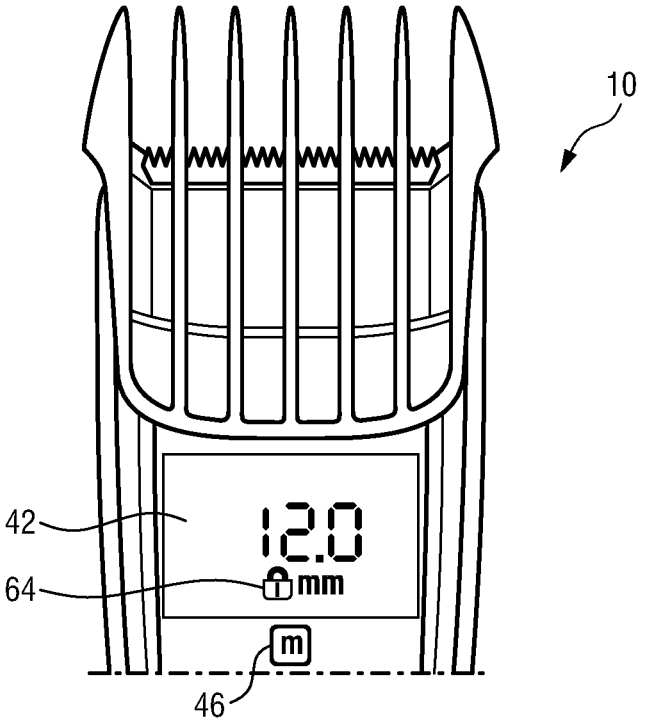
FIG. 6 shows a further enlarged view in which a part of the user interface of the exemplary embodiment of the hair clipping device according to the present invention is shown in detail.

It should be clear that the above-mentioned saving procedure may be realized in the same or a similar manner in case the memory unit 40 comprises only one memory location 62 or more than one memory locations. In case the memory unit 40 comprises only one memory location 62, steps S104-S108 may be omitted. Pressing the memory button 46 for a longer time (predetermined first period of time, step S102) will then directly generate the first memory signal that is sent to the control unit, wherein the control unit will in turn save the position information regarding the selected comb position in the memory unit 40. Instead of providing the feedback to the user that the desired comb setting/position has been saved in the memory unit 40 by letting the selection menu 60 (in this case not needed) blink, the feedback actuator 62 could in case of only one memory location 62 show a specific symbol 64 on the display 42 (see e.g. FIG. 6).

It should be also clear that instead of having only one memory button 46, more than one memory button could be provided, e.g. one memory button for each memory location/bank 62*a-c*.

Figure 8:
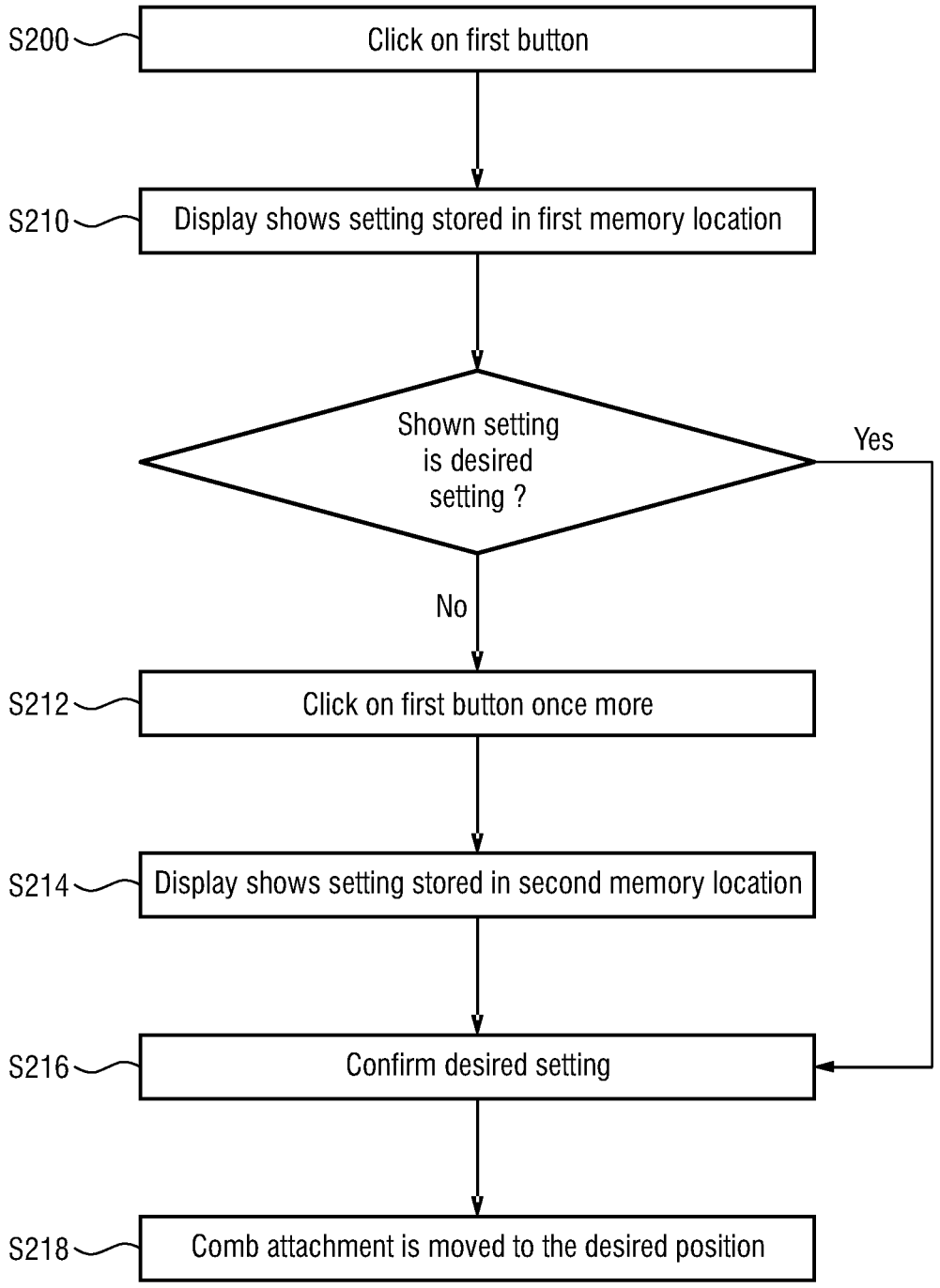
FIG. 8 shows a schematic block diagram illustrating a recalling procedure of the memory function that is provided by the hair clipping device according to the present invention.

FIG. 8 schematically shows the procedure how a user may recall a comb setting/position that has been stored in the memory unit 40. The user thereto only has to press the memory button 46 for less than 1 sec (predetermined second period of time), e.g. by clicking on the memory button 46 (S200). The display 42 will then show the setting stored in the first memory location 62*a* (step S210). If the setting shown on the display 42 is the setting the user desires, he/she may confirm the setting (step S216). Confirming the setting does however not necessarily require an active feedback of the user. The setting could e.g. also be confirmed if the user does nothing after having pressed the memory button 46. If, on the other hand, the user wants to recall the comb setting from the second memory location 62*b*, the user clicks on the memory button 46 once more (or directly twice) (step S212). The display 42 will then show the setting stored in the second memory location 62*b* (step S214). If the user wants to recall the setting from the third memory location 62*c*, he/she has to press the memory button 46 three times. In other words, pressing the memory button 46 once for a predetermined second period of time (e.g. less than 1 sec) will generate a first recall signal that is sent to the control unit 36; pressing the memory button 46 twice for the second predetermined period of time will generate a second recall signal that is sent to the control unit 36; pressing the memory button 46 three times for the second predetermined period of time will generate a third recall signal that is sent to the control unit 36. However, it shall be noted that these different signals are herein only used as an illustrative measure. In practice, the control unit 36 will recognize how often or how long the memory button 46 is pressed, and then react accordingly. If the memory button 46 is pressed once, i.e. if the first recall signal is received, the control unit 36 will control the drive unit 38 to move the comb attachment 12 to the first comb position stored in the first memory location 62*a* of the memory unit 40. If the memory button 46 is pressed twice (i.e. if the second recall signal is received), the control unit 36 will control the drive unit 38 to move the comb attachment 12 to the second comb position stored in the second memory location 62*b* of the memory unit 40. If the memory button 46 is pressed three times, i.e. if the third recall signal is received, the control unit 36 will control the drive unit 38 to move the comb attachment 12 to the third comb position stored in the third memory location 62*c* of the memory unit 40 (S218).

Even though this is not specifically shown in the drawings, the hair clipping device 10 according to the present invention may comprise more than one comb attachment, e.g. a first and a second comb attachment, wherein either the first or the second comb attachment may be attached to the housing 14 of the hair clipping device 10. The hair clipping device 10 may in this case comprise a comb recognition unit that may be integrated into or be part of the control unit 36. This comb recognition unit may be configured to identify whether the first or the second comb attachment is attached to the housing 14 and may change the settings of the control unit 36, the memory unit 40 and/or the user interface 34 depending on the identification of the first or the second comb attachment. This may provide the possibility to use different memory locations for each of the different comb attachments.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair clipping device comprising:

a housing;

a cutting assembly configured to: clip hairs;

a comb attachment attachable to the housing;

a drive unit configured to move the comb attachment relative to the cutting assembly between different comb positions in order to set a haircut length;

a control unit configured to control the drive unit;

a memory unit; and a user interface, comprising an input device, configured to:

receive from a user a memory input, wherein the memory input is received after a first depression of said input device for a predetermined first period of time;

receive from said user at least one additional depression of said input device;

equate said at least one additional depression of said input device with a number of depressions of the input device;

send a memory signal corresponding to the number of depressions of the input device to the control unit;

receive from the user at least one recall input, wherein said at least one recall input is received after a second depression of said input device, wherein said second depression of said input device is for less than a predetermined second period of time;

receive from said user at least one additional depression of said input device;

equate said at least one additional depression of said input device with a number of depressions of said input device; and send a recall signal to the control unit, said recall signal corresponding to the number of depressions of the input device, wherein the control unit is configured to:

store, in response to receiving the memory signal, position information regarding a position of the comb in the memory unit, said position information stored in a location within the memory unit based on the number of depressions of the input device; and recall from the memory unit, in response to receiving the recall signal, position information regarding the comb, wherein the position information is recalled from a position within the memory unit based on the number of depressions of the input device; and control the drive unit to move the comb attachment to a position corresponding to the recalled position information.

2. The hair clipping device according to claim 1, wherein the predetermined second period of time is shorter than the predetermined first period of time.

3. The hair clipping device according to claim 1, wherein the user interface comprises:

a display configured to display one of: a position information regarding an actual comb position and the position information regarding the comb position in response to receiving the recall input.

4. The hair clipping device according to claim 1, further comprising:

a feedback actuator comprising at least one of: an optical, acoustical or tactile actuator, wherein the control unit is configured to:

activate the feedback actuator in response to the position information regarding the comb position being stored in the memory unit.

5. The hair clipping device according to claim 1, wherein the user interface comprises:

a display; and a haircut length controller configured to:

receive from the user, a haircut length input indicative of a desired comb position, wherein the control unit is configured to:

move the comb attachment to the desired comb position in response to the haircut length input.

6. The hair clipping device according to claim 1, wherein the drive unit is configured to move the comb attachment in a stepless manner.

7. The hair clipping device according to claim 1, wherein the drive unit is configured to move the comb attachment in a stepwise manner.

8. The hair clipping device according to claim 1, wherein the hair clipping device comprises:

a first comb attachment: and a second comb attachment, wherein the first comb attachment and the second comb attachment are of different sizes and shapes, and further comprises:

a comb recognition unit that is configured to identify whether one of: the first comb attachment and the second comb attachment is attached to the housing, wherein the recognition unit is configured to:

change settings of one of: the control unit, the memory unit and the user interface depending on the identification of the attached one of: the first comb attachment or the second comb attachment.

9. The hair clipping device according to claim 1, wherein the cutting assembly comprises a moveable cutting blade and a stationary cutting blade, wherein the hair clipping device further comprises:

a motor configured to drive the moveable cutting blade; and an activation button or activation input field configured to activate and deactivate the motor.

10. The hair clipping device according to claim 1, wherein said input device comprises one of: a button and a touch-activated display.

* * * * *